US005413409A

United States Patent [19]

Arai

[11] Patent Number: 5,413,409

[45] Date of Patent: May 9, 1995

[54] DEVICE FOR SUPPORTING A PAPER CASSETTE

[75] Inventor: Kiyotaka Arai, Osaka, Japan

[73] Assignee: Mita Industrial Co., Ltd., Japan

[21] Appl. No.: 101,310

[22] Filed: Aug. 3, 1993

[30] Foreign Application Priority Data

Sep. 16, 1992 [JP] Japan ..... 4-246621

[51] Int. Cl.[6] ..... A47B 88/00

[52] U.S. Cl. ..... 312/330.1; 384/21; 271/162; 271/145

[58] Field of Search ..... 312/330.1, 334.27, 334.39, 312/334.41, 334.44; 384/21; 271/162, 163, 164, 145

[56] References Cited

U.S. PATENT DOCUMENTS

| | | | |
|---|---|---|---|
| 463,932 | 11/1891 | Allison | 312/334.33 |
| 958,018 | 3/1910 | Senge | 312/334.33 |
| 3,185,530 | 5/1965 | Reiss et al. | 384/21 |
| 3,658,399 | 4/1972 | Vogt | 312/334.41 |
| 4,121,878 | 10/1978 | Lokken | 312/334.45 |
| 4,725,108 | 2/1988 | Wilson | 312/334.44 |
| 5,243,736 | 9/1993 | Cannaday et al. | 312/334.27 |

FOREIGN PATENT DOCUMENTS

| | | | |
|---|---|---|---|
| 365035 | 4/1990 | European Pat. Off. | 271/162 |
| 22223 | 2/1983 | Japan | 271/164 |
| 13425 | 1/1991 | Japan | 271/162 |
| 2245886 | 1/1992 | United Kingdom | 271/162 |

*Primary Examiner*—Laurie K. Cranmer
*Assistant Examiner*—Janet M. Wilkens
*Attorney, Agent, or Firm*—Beveridge, DeGrandi, Weilacher & Young

[57] ABSTRACT

A paper cassette is provided having on its bottom surface cassette rails and contact portions. The cassette rails are located in front of the contact portions by a predetermined distance. When the paper cassette is withdrawn, the cassette rails separate away from corresponding rollers before the contact portions come in contact with corresponding stoppers, after which the paper cassette remains supported only by support rails at the contact portions.

3 Claims, 7 Drawing Sheets

DEVICE FOR SUPPORTING A PAPER CASSETTE

FIELD OF THE INVENTION

The present invention relates to a device for supporting a paper cassette that is supported in the housing body of an electrostatic copying machine, a printer or the like in such a manner that it is allowed to be freely withdrawn out and inserted.

DESCRIPTION OF THE PRIOR ART

First, a conventional device for supporting a paper cassette will be described with reference to FIGS. 4 to 7. The device for supporting a paper cassette that is generally designated at 2 is equipped with a support means 6 provided in a housing body 4 of, for example, an electrostatic copying machine and a paper cassette 8 supported by the support means 6. Though not illustrated, the housing body 4 is formed nearly in a rectangular parallelepiped shape as a whole, and an opening 10 for receiving the paper cassette 8 is formed in a side plate 4*a* that constitutes a side portion thereof. The support means 6 includes a pair of support rails 12 that are arranged, in parallel with a spacing, on the right and left sides, rollers 14 which are disposed on the front side of the support rails 12 and of which the outer peripheral surfaces partly protrude beyond the upper surfaces 12*a* of the support rails 12, and stoppers 16 that are provided protruding from the upper surfaces 12*a* of the support rails 12 in front of the rollers 14. The support rails 12 extend from the front side toward the rear side along both sides of the opening 10.

In this specification, the "right and left" denotes a front-and-rear direction in FIG. 5 (right-and-left direction in FIG. 6), the "front side" denotes the left side in FIG. 5, i.e., the side close to the opening 10 of the housing body 4, and the "rear side" denotes the right side of FIG. 5, i.e., the side remote from the opening 10 of the housing body 4.

The support rails 12 are formed by bending the plate member in L-shape, and the upper surfaces 12*a* thereof are formed substantially horizontally and flat. The distance between the rollers 14 is arranged to be different from the distance between the stoppers 16 (in this case, the distance between the stoppers 16 is greater than that between the rollers). In the substantially rectangularly-shaped paper cassette 8 is formed a recessed portion 8*a* that receives the copying papers, and at an upper part in front thereof is rotatably provided a hook 8*b* (shown in FIG. 5 only). The hook 8*b* is always urged in the counterclockwise direction by a spring means that is not shown, and engages with an engaging hole 4*c* of a hook-engaging portion 4*b* provided on the side plate 4*a* of the housing when the paper cassette 8 is completely inserted in the opening 10.

On the bottom surface of the paper cassette 8 are formed a pair of rails 18 (hereinafter simply referred to as "support rails") that are arranged, in parallel with a spacing, on the right and left and that downwardly protrude from the bottom surface. A pair of contact portions 20 are arranged at a distance on the right and left on the rear side of the paper cassette 8 and downwardly protrude from the bottom surface. The paper cassette 8 is made from a plastic material, and the supported rails 18 and the contact portions 20 are formed together as a unitary structure. The distance between the supported rails 18 is nearly the same as the distance between the rollers 14, and the distance between the contact portions 20 is nearly the same as the distance between the stoppers 16.

The supported rails 18 of the paper cassette 8 are supported by the corresponding rollers 14, and the contact portions 20 are slidably supported by the upper surfaces 12*a* of the corresponding support rails 12, so that the paper cassette 8 is supported by the support means 6 in a manner of being freely drawn out and inserted. The position at which the paper cassette 8 has been drawn out is defined by the state where the contact portions 20 come in contact with the corresponding stoppers 16 (see FIG. 7). Furthermore, the position (accommodation position) into which the paper cassette 8 has been inserted is held by the hook 8*b* that comes into engagement with the engaging hole 4*c* of the hook-engaging portion 4*b* (see FIG. 5).

The bottom surface of the paper cassette 8 is supported by the corresponding rollers 14 via the supported rails 18. In general, the ends of the rear side of the supported rails 18 are located at the positions of the contact portions 20 or at the positions which are on the rear side beyond the positions of the contact portions 20 as seen in the illustrated prior art. As shown in FIG. 7, therefore, the supported rails 18 are placed under the condition of being supported by the corresponding rollers 14 (placed under the contacting condition) when the paper cassette 8 is drawn out until the contact portions 20 come in contact with the stoppers 16. In other words, the paper cassette 8 is supported by the corresponding rollers 14 via the supported rails 18 between from the state where it starts to be drawn out until the state where the contact portions 20 come in contact with the stoppers 16. The resulting advantage, therefore, is that the paper cassette 8 slides very well and can, hence, be drawn out and inserted with a small force.

When a user forcibly draws out the paper cassette 8, however, the paper cassette 8 slides so easily that the contact portions 20 of the paper cassette 8 often slide over the stoppers 16 even though the user does not wish the paper cassette 8 to be completely pulled out. This becomes more likely to happen particularly when the front side of the paper cassette 8 is slightly lifted up instead of being maintained horizontal. To solve this problem, it is possible to conceive of increasing the height of the stoppers 16. In this case, however, it becomes difficult to insert the paper cassette 8 though the contact portions 20 of the paper cassette 8 can be prevented from sliding over the stoppers 16.

SUMMARY OF THE INVENTION

The object of the present invention is to provide an improved device for supporting a paper cassette, which reliably prevents the contact portions of the paper cassette from sliding over the corresponding stoppers while yet maintaining good sliding performance of the paper cassette.

In order to accomplish the above object, according to the present invention, there is provided a device for supporting a paper cassette comprising a support means provided in a housing body and a paper cassette supported by said support means, wherein said support means includes a pair of support rails arranged, in parallel with a spacing, on the right and left, rollers which are disposed on the front side of the support rails and of which the outer peripheral surfaces partly protrude beyond the upper surfaces of the support rails, and stoppers that are protruding from the upper surfaces of the support rails in front of the rollers, and wherein a distance between the rollers is arranged to be different from a distance between the stoppers, on the bottom surface of said paper cassette are formed a pair of rails to be supported that are arranged, in parallel with a spacing on the right and left and that downwardly protrude from said bottom surface, and a pair of contact portions that are arranged on the right and left at a distance on the rear side of said paper cassette and that downwardly protrude from said bottom surface, said rails to be supported are supported by said corresponding rollers, said contact portions are slidably supported by the upper surfaces of the corresponding support rails, so that said paper cassette is supported by said support means in a manner of being freely drawn out and inserted, and the position at which said paper cassette has been drawn out is defined by the state where said contact portions come in contact with said corresponding stoppers, the improvement wherein the ends of the rear side of the rails to be supported of said paper cassette are located in front of the contact portions by a predetermined distance, so that when said paper cassette is drawn out, said rails to be supported are separated from said corresponding rollers before the contact portions come in contact with said corresponding stoppers, and said paper cassette is supported by said support rails at said contact portions only.

DESCRIPTION OF THE PREFERRED EMBODIMENT

Figure 1:
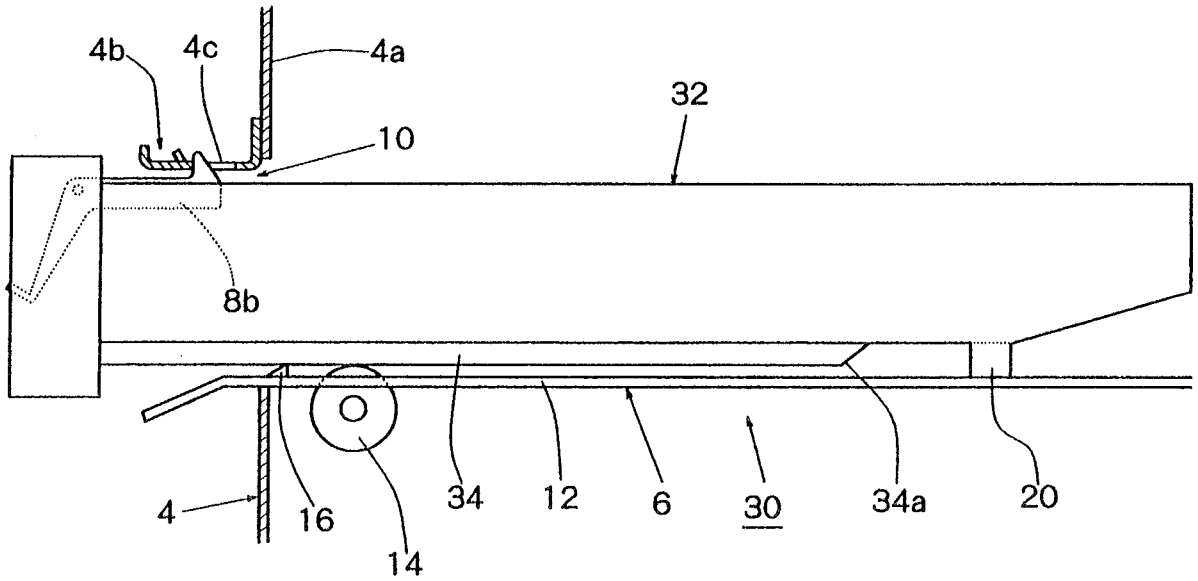
FIG. 1 is a side view schematically illustrating, partly in cross section, a device for supporting a paper cassette improved according to an embodiment of the present invention.
Figure 2:
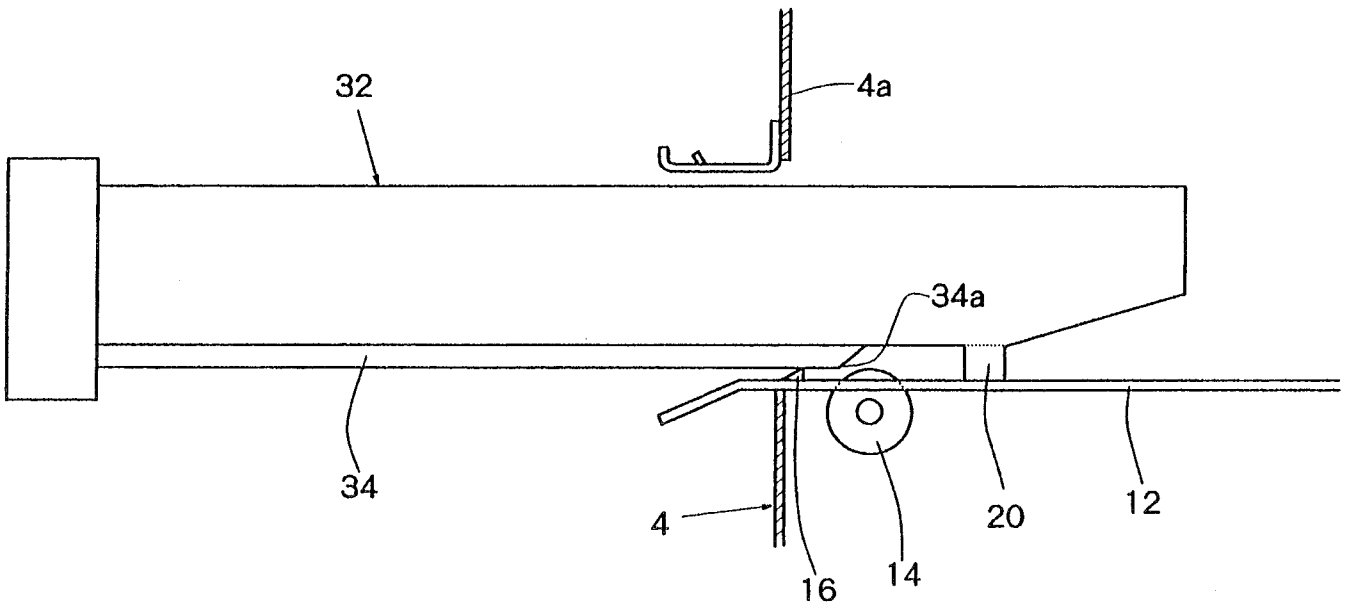
FIG. 2 is a side view schematically illustrating a mode of operation of the paper cassette of FIG 1;.
Figure 3:
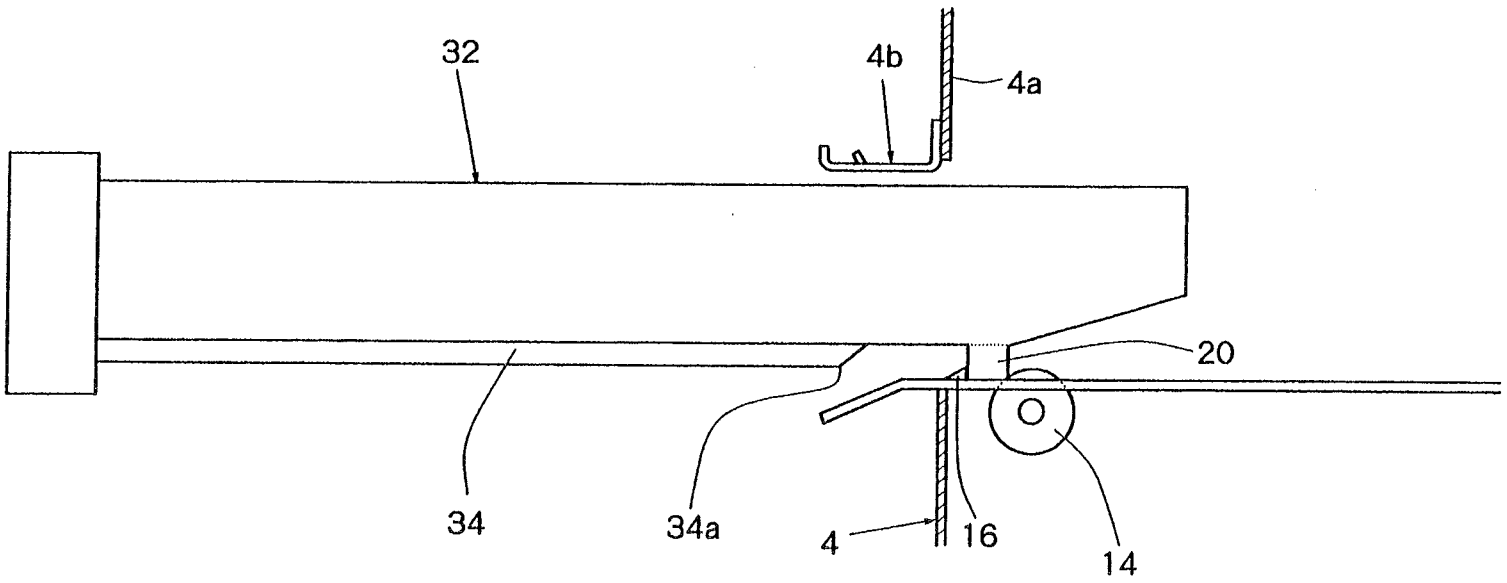
FIG. 3 is a side view schematically illustrating another mode of operation of the paper cassette of FIG. 1.
Figure 4:
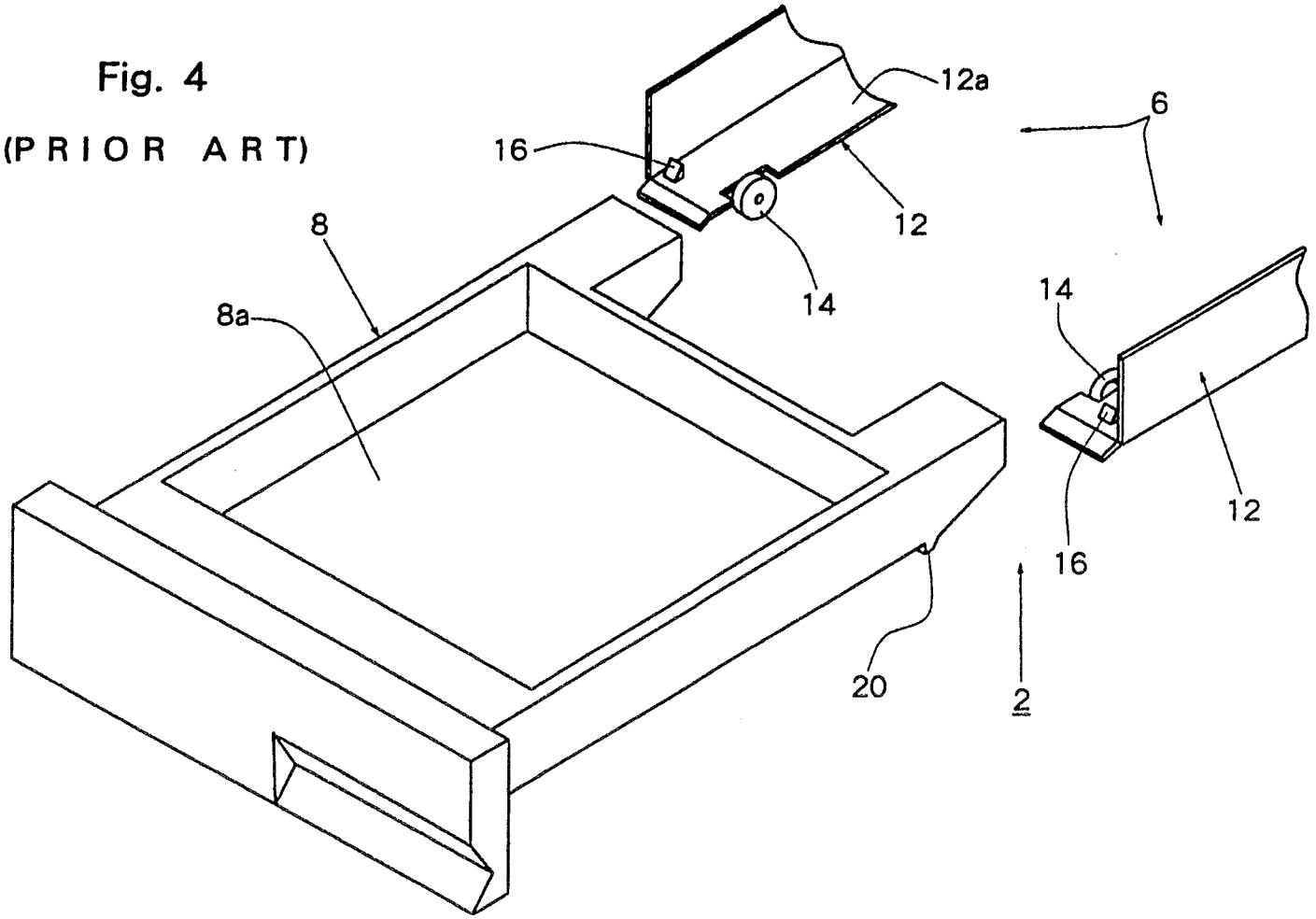
Fig. 4 (PRIOR ART)
FIG. 4 is a perspective view which schematically shows a conventional device for supporting the paper cassette in a disassembled manner.
Figure 5:
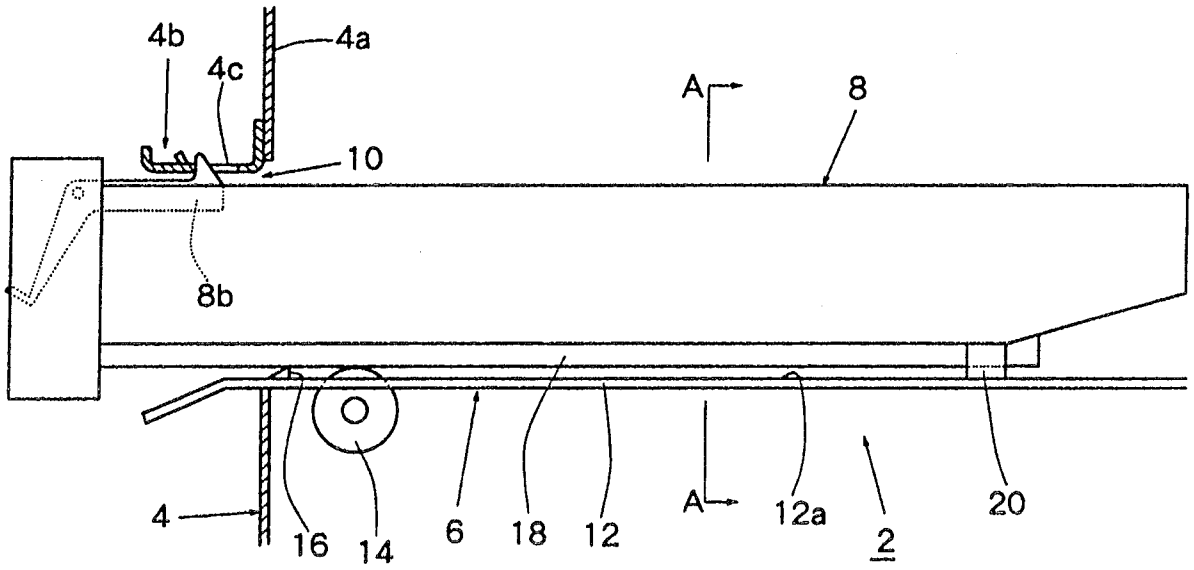
Fig. 5 (PRIOR ART)
FIG. 5 is a side view schematically illustrating, partly in cross section, the device for supporting a paper cassette of FIG. 4.
Figure 6:
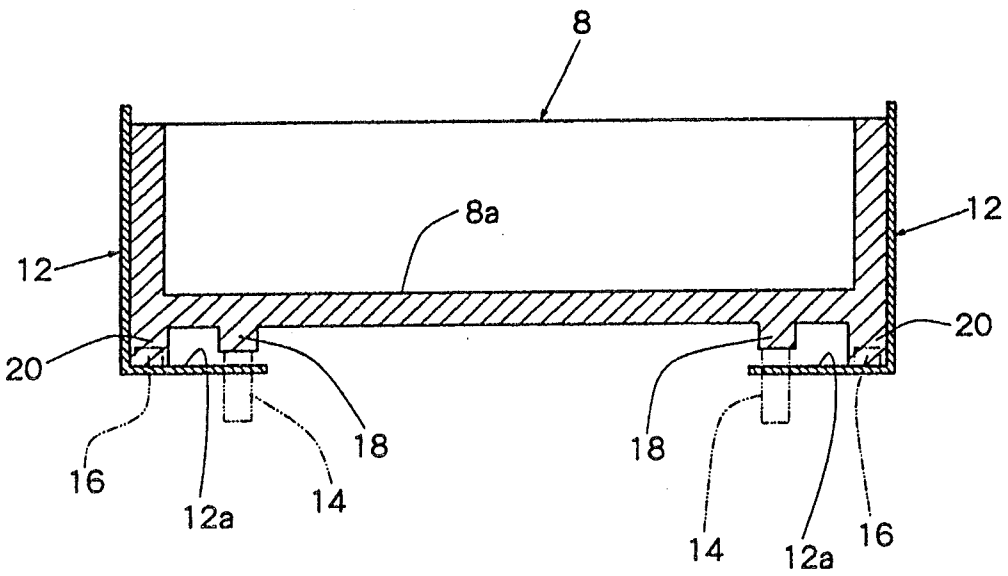
Fig. 6 (PRIOR ART)
FIG. 6 is a sectional view along arrow A—A of FIG. 5.
Figure 7:
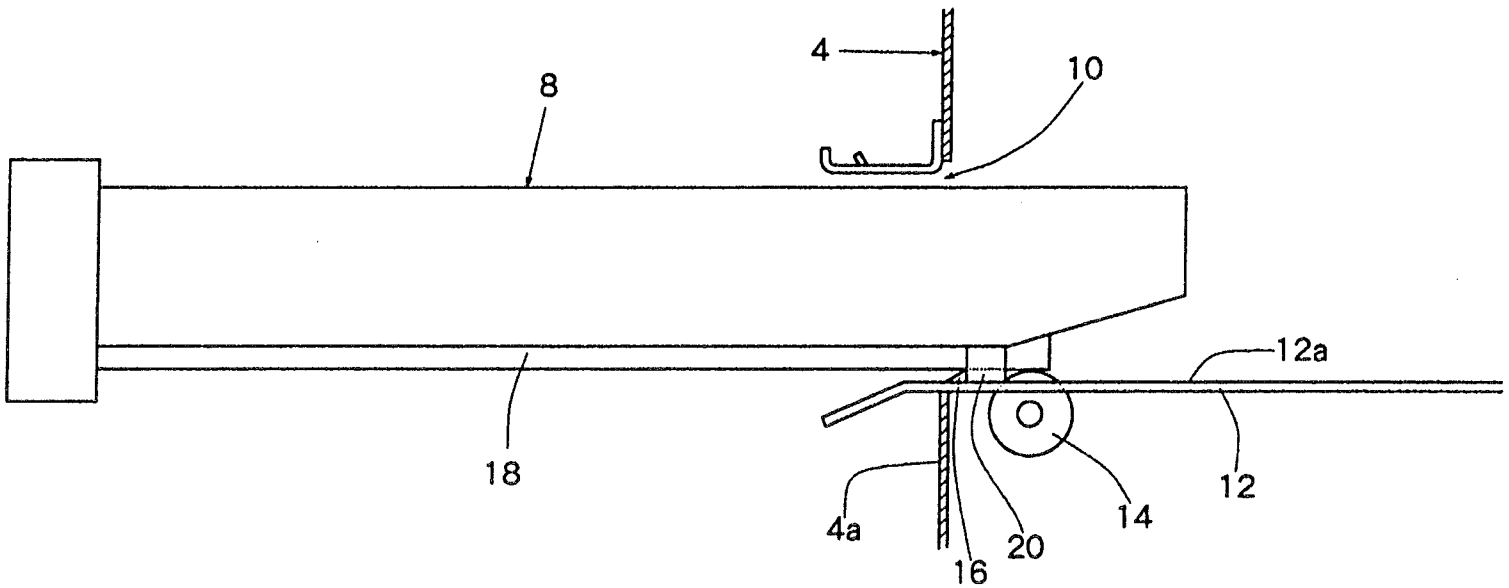
Fig. 7 (PRIOR ART)
FIG. 7 is a side view schematically illustrating a mode of operation of the paper cassette of FIG. 5.

A device for supporting a paper cassette improved according to an embodiment of the present invention will now be described in detail with reference to FIGS. 1 to 3. The portions same as those of the conventional device 2 for supporting the paper cassette shown in FIGS. 4 to 7 are denoted by the same reference numerals but are not described here again. Referring, first, to FIG. 1, a device 30 for supporting a paper cassette improved according to the present invention comprises a support means 6 provided in the housing body 4 and a paper cassette 32 supported by the support means 6. The support means 6 is constituted in substantially the same manner as the conventional device 2 for supporting the paper cassette. The paper cassette 32 is constituted in substantially the same manner as the conventional paper cassette 8 except for the constitution of the pair of support rails 34 formed on the bottom surface thereof.

On the bottom surface of the paper cassette 32 are formed a pair of supported rails 34 that are arranged, in parallel and spaced apart on the right and left sides of the cassette. The rails 34 downwardly protrude from the bottom surface of the cassette 32. Ends **34*a* of the rear side of the support rails 34 are located in front of the contact portions 20 by a predetermined distance. That is, a predetermined distance is set between the contact portions 20 and the ends 34*a* of the rear side of the support rails 34. When the paper cassette 32 is drawn out, the support rails 34 are spaced away from the rollers 14 before the contact portions 20 come in contact with the corresponding stoppers 16. At the same time, the paper cassette 32 is supported by the support rails 12 at the contact portions 20 only (see FIG. 2). When further drawn out, the paper cassette 32 moves in this state then, the contact portions 20 come in contact with the stoppers 16, and the drawing-out operation is halted (see FIG. 3). After the supported rails 34 are separated away from the corresponding rollers 14, the sliding performance decreases and the contact portions come into reliable contact with the corresponding stoppers 16 even when the paper cassette 32** is horizontally drawn out or is drawn out with its front side being slightly lifted up.

According to the present invention, it is made possible to reliably prevent the contact portions of the paper cassette from sliding over the corresponding stoppers while maintaining good sliding performance of the paper cassette. That is, when the paper cassette is drawn out, the supported rails separate away from the corresponding rollers before the contact portions come in contact with the corresponding stoppers. At the same time, the paper cassette is supported by the support rails at the contact portions only, and the sliding performance decreases. Moreover, the speed of drawing-out the paper cassette is also decreased. Even when the paper cassette is forcibly drawn, therefore, the contact portions come into reliable contact with the corresponding stoppers. The supported rails of the paper cassette are separated away from the corresponding rollers during the drawing-out operation just before the contact portions come in contact with the corresponding stoppers. That is, the paper cassette is supported by the corresponding rollers via the supported rails during most of the operation for drawing-out or inserting the paper cassette. Therefore, good sliding performance of the paper cassette is sufficiently maintained.

Though the present invention was described above in detail by way of an embodiment, it should be noted that the invention is in no way limited to the above embodiment only but can be varied or modified in a variety of other ways without departing from the scope of the invention.

What I claim is:

1. A device for supporting a paper cassette comprising:

a support means provided in a housing body and a paper cassette supported by said support means, said support means including a pair of support rails arranged, in parallel and spaced from each other on right and left sides of said support means, rollers which are located at a front side of the support rails, the rollers having outer peripheral surfaces that partly protrude beyond upper surfaces of the support rails, and stoppers that protrude from the upper surfaces of said support rails in front of said rollers, wherein a distance between said rollers is different from a distance between said stoppers, said paper cassette including a pair of cassette rails on a bottom surface of said cassette said rails being arranged, in parallel with and spaced from each other on right and left sides of said cassette and downwardly protruding from said bottom surface of said cassette, and a pair of contact portions arranged on the right and left sides of said cassette at a predetermined distance toward a rear side of said paper cassette, said contact portions downwardly protruding from said cassette bottom surface, said cassette rails being supported by corresponding rollers, said contact portions being slidably supported by the upper surfaces of corresponding support rails, so that said paper cassette is supported in a manner allowing free withdrawal from and insertion into said housing body, and said paper cassette has a withdrawn position which is where said contact portions come into contact with corresponding stoppers of the support means, wherein ends of a rear side of the cassette rails are located in front of said contact portions by a predetermined distance, so that when said paper cassette is being withdrawn from said housing body, said cassette rails are separated from said corresponding rollers before said contact portions come into contact with said corresponding stoppers, and said paper cassette thereafter is supported by said support rails only at said contact portions.

2. A paper cassette supportable by support means provided in a housing body of an image forming machine, wherein the support means includes a pair of parallel support rails spaced apart from each other on right and left sides of the support means, a roller located at a front portion of each of the support rails, each roller having an outer peripheral surface that partly protrudes beyond an upper surface of its associated support rail, and a stopper that protrudes from the upper surface of each of the support rails, each stopper being located closer to a front edge of its associated support rail front portion than its associated roller, said paper cassette comprising:

a pair of cassette rails located on a bottom surface of said cassette, said cassette rails being arranged in parallel and spaced from each other on right and left sides of said cassette, said cassette rails each having a rear end portion, a pair of contact portions, said contact portions being spaced apart on right and left sides of said cassette respectively, each of said contact portions being located a predetermined distance rearwardly of an associated one of said cassette rail rear end portions, said paper cassette rails being supportable on corresponding rollers of the support means, said contact portions being slidably supportable by the upper surface of the corresponding support rails of the support means, whereby said paper cassette is supported in a manner allowing free withdrawal from and insertion into the housing body, and said paper cassette having a withdrawn position which is where said contact portions come into contact with corresponding stoppers of the support means, wherein, when said paper cassette is being withdrawn from the housing body, said cassette rails separate from their corresponding supporting means rollers before said contact portions come into contact with the corresponding supporting means stoppers, and said paper cassette thereafter is supported by the support rails only at said contact portions.

3. A support means locatable within a housing body for supporting a paper cassette therein, wherein the paper cassette includes a pair of cassette rails located on a bottom surface of said cassette, the cassette rails being arranged in parallel and spaced from each other on right and left sides of the cassette, the cassette rails each having a rear end portion, a pair of contact portions, the contact portions being spaced apart on right and left sides of the cassette respectively, each of the contact portions being located a predetermined distance rearwardly of an associated one of the cassette rail rear end portions, said support means comprising:

a pair of parallel support rails spaced apart from each other on right and left sides of the support means, each of the cassette contact portions being slidably supportable by an upper surface of a corresponding one of said support rails of said support means, whereby the paper cassette is supported in a manner allowing free withdrawal from and insertion into said housing body, a roller located at a front portion of each of said support rails, each roller having an outer peripheral surface that partly protrudes beyond said upper surface of its associated support rail, the paper cassette rails being supportable by corresponding of said rollers, a stopper that protrudes from said upper surface of each of said support rails, each stopper being located closer to a front edge of its associated support rail front portion than its associated roller, and said rollers and said stoppers being arranged so that the paper cassette has a withdrawn position which is where the cassette contact portions come into contact with said corresponding stoppers of said support means, wherein, when the paper cassette is being withdrawn from said housing body, the cassette rails separate from said corresponding supporting means rollers before the cassette contact portions come into contact with said corresponding supporting means stoppers, and the paper cassette thereafter is supported by said support rails only at the cassette contact portions.

* * * * *